US008328348B2

(12) United States Patent
Chino et al.

(10) Patent No.: US 8,328,348 B2
(45) Date of Patent: Dec. 11, 2012

(54) HEATER UNIT AND LIQUID EJECTION DEVICE

(75) Inventors: Toru Chino, Nagano (JP); Hidemasa Kanada, Nagano (JP); Hiroshi Miyazawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 163 days.

(21) Appl. No.: 13/013,207

(22) Filed: Jan. 25, 2011

(65) Prior Publication Data

US 2011/0221840 A1 Sep. 15, 2011

(30) Foreign Application Priority Data

Mar. 10, 2010 (JP) ..... 2010-053366

(51) Int. Cl.
*B41J 2/01* (2006.01)

(52) U.S. Cl. ..... 347/102
(58) Field of Classification Search ..... None
See application file for complete search history.

(56) References Cited

FOREIGN PATENT DOCUMENTS

JP 2004-039502 A 2/2004

*Primary Examiner* — Stephen Meier
*Assistant Examiner* — Tracey McMillion
(74) *Attorney, Agent, or Firm* — Global IP Counselors, LLP

(57) ABSTRACT

The heater unit includes: a locking device selectable between a locked state in which the heater unit chassis is locked in the printer chassis, and an unlocked state in which the printer chassis and the heater unit chassis are unlocked; and a grip portion. When the grip portion is in a first operating position, the locking device is held in the locked state, and when the grip portion is in a second operating position, the locking device is held in the unlocked state. The operating state of the locking device changes in an interlocked manner with switching of the operating position of the grip portion.

8 Claims, 5 Drawing Sheets

HEATER UNIT AND LIQUID EJECTION DEVICE

CROSS-REFERENCE TO RELATED APPLICATIONS

This application claims priority to Japanese Patent Application No. 2010-053366 filed on Mar. 10, 2010. The entire disclosure of Japanese Patent Application No. 2010-053366 is hereby incorporated herein by reference.

BACKGROUND

1. Technical Field

The present invention relates to a heater unit for use in a liquid ejection device, and relates in particular to a heater unit featuring ease of replacement. The invention also relates to a liquid ejection device furnished with the heater unit.

2. Related Art

Typically, inkjet printers and other such liquid ejection devices employed for printing purposes use a heater unit in order to dry ink or other liquid that has been ejected onto recording paper or the like.

Because conventional heater units are secured in place in the printer chassis by screw fastening or the like, the replacement operation is laborious. Meanwhile, in Japanese Laid-Open Patent Application 2004-39502 there is proposed a technique relating to heater units for electrophotographic image forming devices such as copiers, printers, and facsimile devices, and intended to facilitate the replacement operation for a heated roller unit.

SUMMARY

It may be contemplated to facilitate the heater unit replacement procedure through implementation of the features taught in Japanese Laid-Open Patent Application 2004-39502 in a heater unit for a liquid ejection device.

However, when replacing the heater unit of Japanese Laid-Open Patent Application 2004-39502, the user is required to perform the operation while holding with both hands grip portions that are provided at the two lengthwise ends. Therefore, both hands are occupied in supporting the heater unit, making it difficult to perform other operations concurrently. Moreover, given current demand for universal designs, there exists a need for further improvement in ease of operation.

It is accordingly an object of the present invention to provide a heater unit and a liquid ejection device designed to make the replacement operation easier to perform.

A heater unit according to a first aspect of the present invention includes a locking device and a grip portion. The locking device is selectable between a locked state in which a heater unit chassis is locked in a printer chassis, and an unlocked state in which the printer chassis and the heater unit chassis are unlocked. The grip portion configured to be gripped by an operator during a replacement operation. The grip portion and the locking device being arranged such that: when the grip portion is in a first operating position, the locking device is held in the locked state; when the grip portion is in a second operating position, the locking device is held in the unlocked state; an operating state of the locking device changes from the locked state to the unlocked state in an interlocked manner with switching of a operating position of the grip portion from the first operating position to the second operating position; and the operating state of the locking device changes from the unlocked state to the locked state in an interlocked manner with switching of the operating position of the grip portion from the second operating position to the first operating position.

According to this aspect, locking of the printer chassis and the heater unit chassis, as well as unlocking of the printer chassis and the heater unit chassis, take place in an interlocked manner with operation of the grip portion by the user, and therefore the heater unit replacement operation may be carried out easily.

In the heater unit as described above, the grip portion preferably retracts into the heater unit chassis in the first operating position, and preferably extends from the heater unit chassis in the second operating position.

According to this aspect, when in the first operating position, i.e., with the locking device held in the locked state, the grip portion retracts into the heater unit chassis. Consequently, in the locked state, the heater unit has a small profile. On the other hand, when in the second operating position, i.e., with the locking device held in the unlocked state, the grip portion extends from the heater unit chassis. Consequently, the grip portion may be grasped to attach or detach the heater unit.

In the heater unit as described above, the grip portion preferably switches the operating position by turning about a turn shaft disposed in the heater unit chassis. The locking device preferably includes a cam disposed on a perimeter of the turn shaft and configured to turn in tandem with the turn shaft, a cam receiving portion configured to travel in an axial direction of the turn shaft in association with change of contact location with the cam, and a locking pin configured to travel in an axial direction of the turn shaft in tandem with the cam receiving portion. When the operating position of the grip portion changes from the first operating position to the second operating position in association with turning of the grip portion, a contact location of the cam and the cam receiving portion preferably changes due to turning of the cam in tandem with turning of the turn shaft, and due to the change in the contact location, the cam receiving portion and the locking pin preferably travel in an axial direction of the turn shaft, the locking pin is preferably inserted into a lock hole of the printer chassis, and the printer chassis and the heater unit chassis are preferably locked through insertion of the locking pin into the lock hole.

According to this aspect, a feature whereby the printer chassis and the heater unit chassis become locked in association with change from the first operating position to the second operating position may be realized through application of a generic technique.

The heater unit as described above preferably further includes electrical contacts for electrical connection to the printer chassis, with the electrical contacts being positioned in the vicinity of the lock holes of the printer chassis in the locked state.

According to this aspect, the electrical contacts are positioned so as to be situated in the vicinity of the lock holes of the printer chassis in the locked state, thereby becoming electrically connected in the vicinity of the locations at which the contacts are positioned through locking. Consequently, faulty electrical contact between the printer chassis and the heater unit due to the effect of tolerance may be inhibited.

The distance referred to herein using the term "vicinity" refers to one close enough to inhibit electrical contact due to the effect of tolerance.

A liquid ejection device according to another aspect includes a liquid ejection head configured to eject a liquid onto a recording medium, a feed unit configured to feed the recording medium along a feed path for feeding the recording medium onto which the liquid has been ejected by the liquid ejection head, and the aforementioned heater unit disposed on the feed path to dry the liquid on the recording medium.

The liquid ejection device according to the above invention affords working effects comparable to those of the heater unit disclosed above.

BRIEF DESCRIPTION OF THE DRAWINGS

Referring now to the attached drawings which form a part of this original disclosure:

FIGS. 3A and 3B are drawings depicting the heater unit shown in FIG. 2 with the housing removed, wherein FIG. 3A is a perspective view showing the state of the first operating position, and FIG. 3B is a perspective view showing the state of the second operating position;

FIGS. 5A and 5B are drawings depicting in front view a locking device of the heater unit shown in FIG. 2, wherein FIG. 5A shows the state of the first operating position, and FIG. 5B shows the state of the second operating position.

DETAILED DESCRIPTION OF EXEMPLARY EMBODIMENTS

Figure 1:
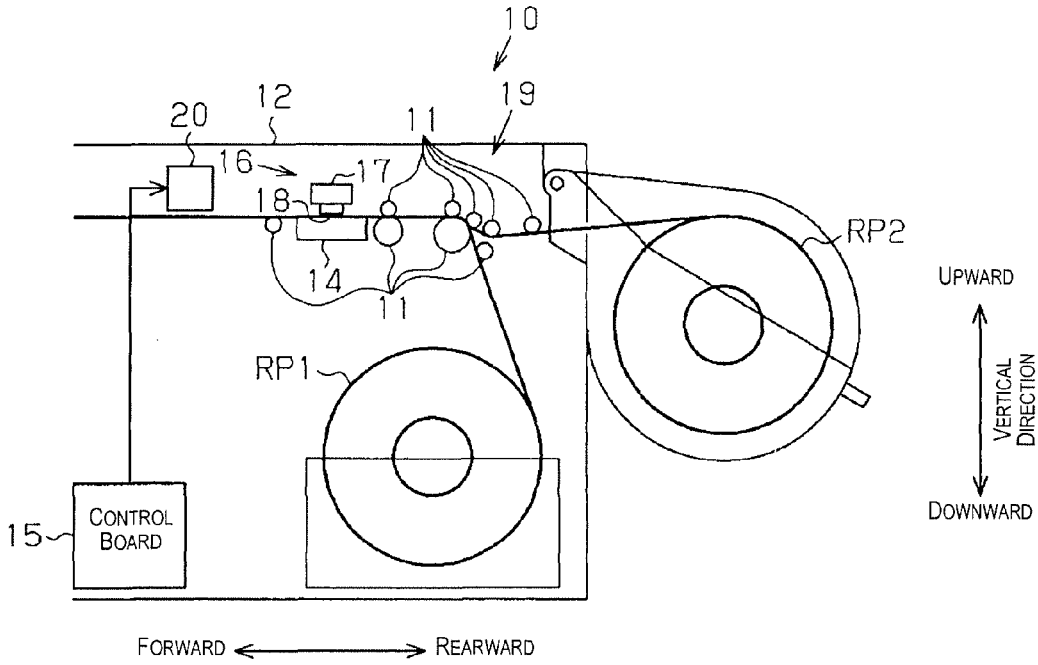
FIG. 1 is a representative schematic cutaway view of an inkjet printer according to one embodiment of the present invention, seen from the right side.

An embodiment relating to implementation of the liquid ejection device of the present invention in an inkjet printer is described below making reference to FIGS. 1 to 5B. In the following description, unless expressly indicated otherwise, directions and orientations are those indicated by the arrow symbols in the drawings. While not indicated in FIG. 1, the direction orthogonal to the plane of the page is designated as the lengthwise direction; in the lengthwise direction, the frontward direction with respect to the plane of the page is designated as rightward, and the rearward direction as leftward.

As shown in FIG. 1, the inkjet printer provided as the liquid ejection device is furnished with the principal components thereof disposed within a frame 12 generally rectangular box shape. A platen 14 is disposed extending in the lengthwise direction inside the frame 12. At a location facing the platen 14, an ejection head 17 is reciprocably disposed along the lengthwise direction, with ejection nozzles 18 facing towards the platen 14. Recording paper RP1 is detachably retained in the lower rear part inside the frame 12, while a spare roll of recording paper RP2 provided as the recording medium is detachably retained so as to protrude rearward from the upper part of the frame 12. Either the recording paper RP1 or the recording paper RP2 is selectable, as needed. One edge of the recording paper RP1 is guided by a plurality of rollers 11 provided as a feeding unit, and passes between the platen 14 and the ejection head 17 as the medium is fed towards the front of the inkjet printer. A heater unit 20 is disposed on the feed path over which the recording medium travels between the platen 14 and the ejection head 17.

In printing status, printing is carried out by ejecting printing ink onto the recording paper RP1 from the ejection nozzles 18 while moving the ejection head 17 left and right in the lengthwise direction. The rollers 11 advance the recording paper RP1 in tandem with the printing operation, whereby printing takes place in continuous fashion. Subsequent to printing, the recording paper RP1 passes below the heater unit 20 whereby the liquid ink that has been ejected onto the recording paper RP1 is dried by hot air emitted by the heater unit 20. This heater unit 20 is electrically connected to a control board 15 provided to the printer chassis 10 for supply of power, control of temperature, and so on.

Figure 2:
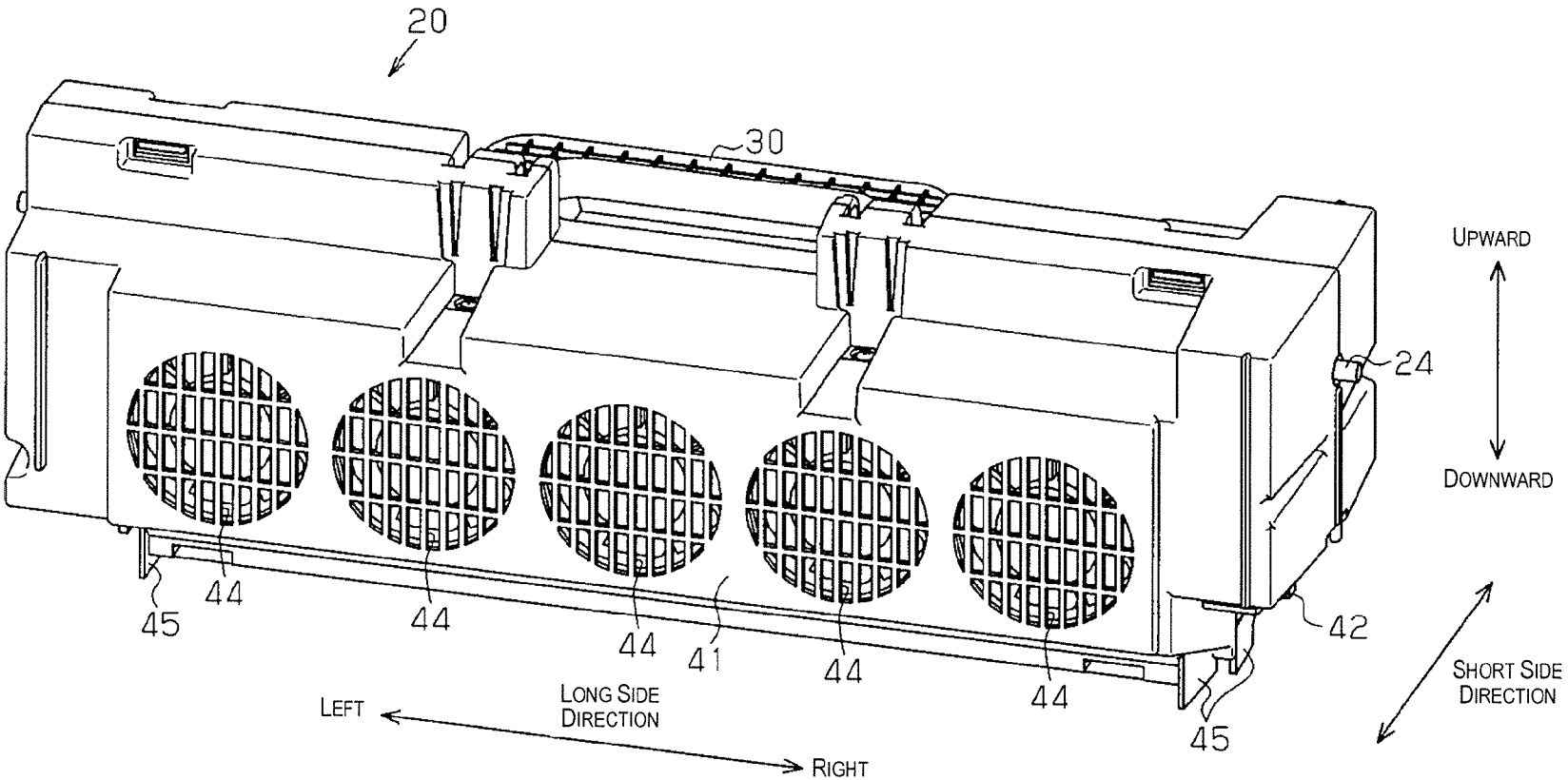
FIG. 2 is an overall perspective view of a heater unit provided to the inkjet printer according the embodiment.

As shown in FIG. 2, the heater unit 20 has a generally cuboid shape covered by a housing 41. Air that is drawn in through a plurality of intake ports 44 disposed along one side face in the short side direction is heated by a heater (not shown), and is discharged as hot air from discharge ports (not shown) disposed on the bottom of the heater unit 20. A grip portion 30 is provided at the top, allowing the heater unit 20 to be detached from the printer chassis by gripping the grip portion 30 and lifting upward. On the other hand, during installation of the heater unit 20 in the printer chassis, a plurality of installation projections 45 disposed on the bottom of the heater unit 20 insert into recessed portions (not shown) provided to the printer chassis, thereby restricting movement in the long side direction and in the short side direction. Furthermore, locking pins 24 project out from the left and right end faces in the long side direction, and these locking pins 24 insert into lock holes (not shown) provided to the printer chassis, thereby locking the heater unit chassis to the printer chassis. All of these operations are possible while holding the grip portion 30 with one hand. Plugs 42 which serve as electrical contacts for electrical connection to the printer chassis are disposed at the left and ends in the lengthwise direction, and on the bottom. Because the plugs 42 are situated in proximity to the locking locations of locking by the locking pins 24, the plug 42 connections are largely unaffected by tolerance provided to the heater unit 20 and the printer chassis.

Figure 3A:
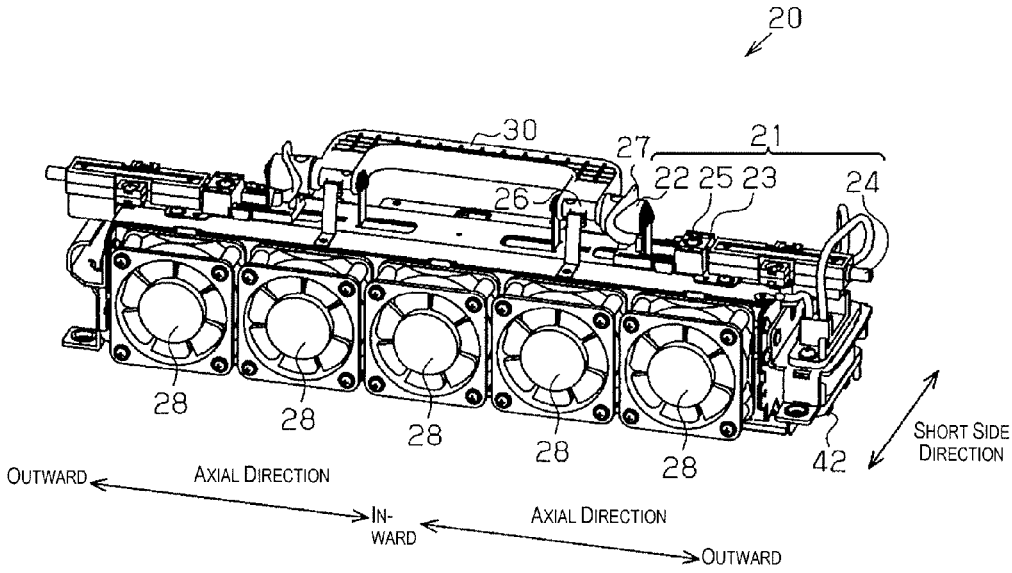
Figure 3B:
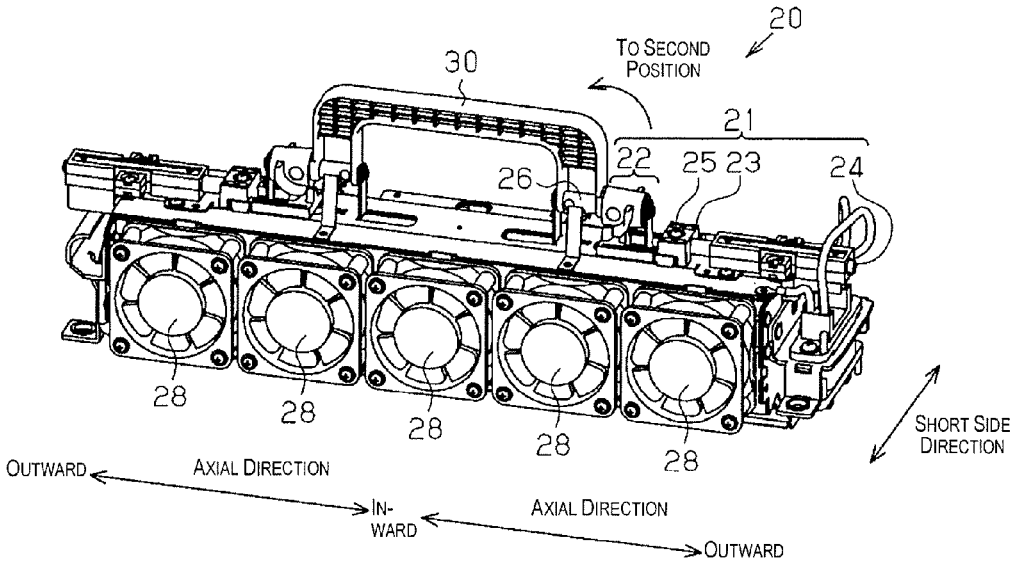

FIG. 3 shows perspective views of the heater unit 20 with the housing 41 detached. On the side wall in the short side direction, fans 28 are disposed at locations corresponding to the intake ports 44 so that air can be drawn in from the outside. The grip portion 30 is integrally formed with a turn shaft 26, and this turn shaft 26 is rotatably disposed on the heater unit chassis. Consequently, the operating position is switched through rotation by approximately 90° C. about the turn shaft 26. The operating position shown in FIG. 3A is designated as the first operating position, and the operating position shown in FIG. 3B is designated as the second operating position. As will be appreciated from FIG. 3A and FIG. 2, in the first operating position, the grip portion 30 is collapsed and retracted into the heater unit 20, and therefore is difficult to grip. As will be appreciated from FIG. 3B, in the second operating position, the grip portion 30 extends out from the heater unit 20 and therefore is easily gripped.

Figure 4:
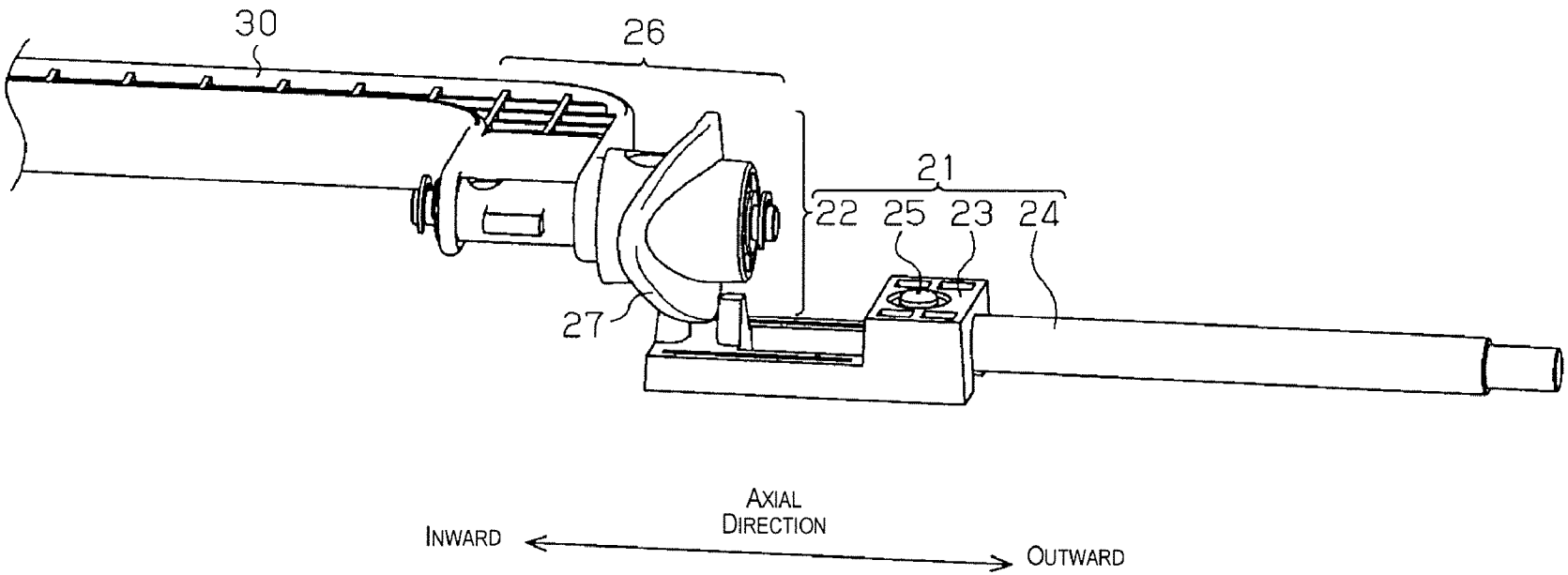
FIG. 4 is a fragmentary enlarged view of a locking device of the heater unit shown in FIG. 2.

As shown in FIG. 4, a cylindrical cam 22 that turns in tandem with the turn shaft 26 is disposed on the outside circumference of the turn shaft 26. More specifically, the cylindrical cam 22 is a cylindrical rib cam for converting rotational movement to linear movement using a rib 27. A cam receiving portion 23 meshes with the rib 27 of the cylindrical cam 22. Additionally, the locking pin 24 is fastened by a screw 25 to the axial outside end of the cam receiving portion 23. Consequently, shifting of operating position of the grip portion 30 is transmitted to the locking pin 24 via the turn shaft 26 the cylindrical cam 22, and the cam receiving portion 23 in succession. Specifically, the cylindrical cam 22, the cam receiving portion 23, the locking pin 24, and the screw 25 make up a locking device 21. Of these components, the cylindrical cam 22 is rotatably fastened to the heater unit chassis as described above. Meanwhile, the cam receiving portion 23 and the locking pin 24 are fastened to the heater unit chassis so as to be capable of traveling in the axial direction.

Figures 5A, 5B:
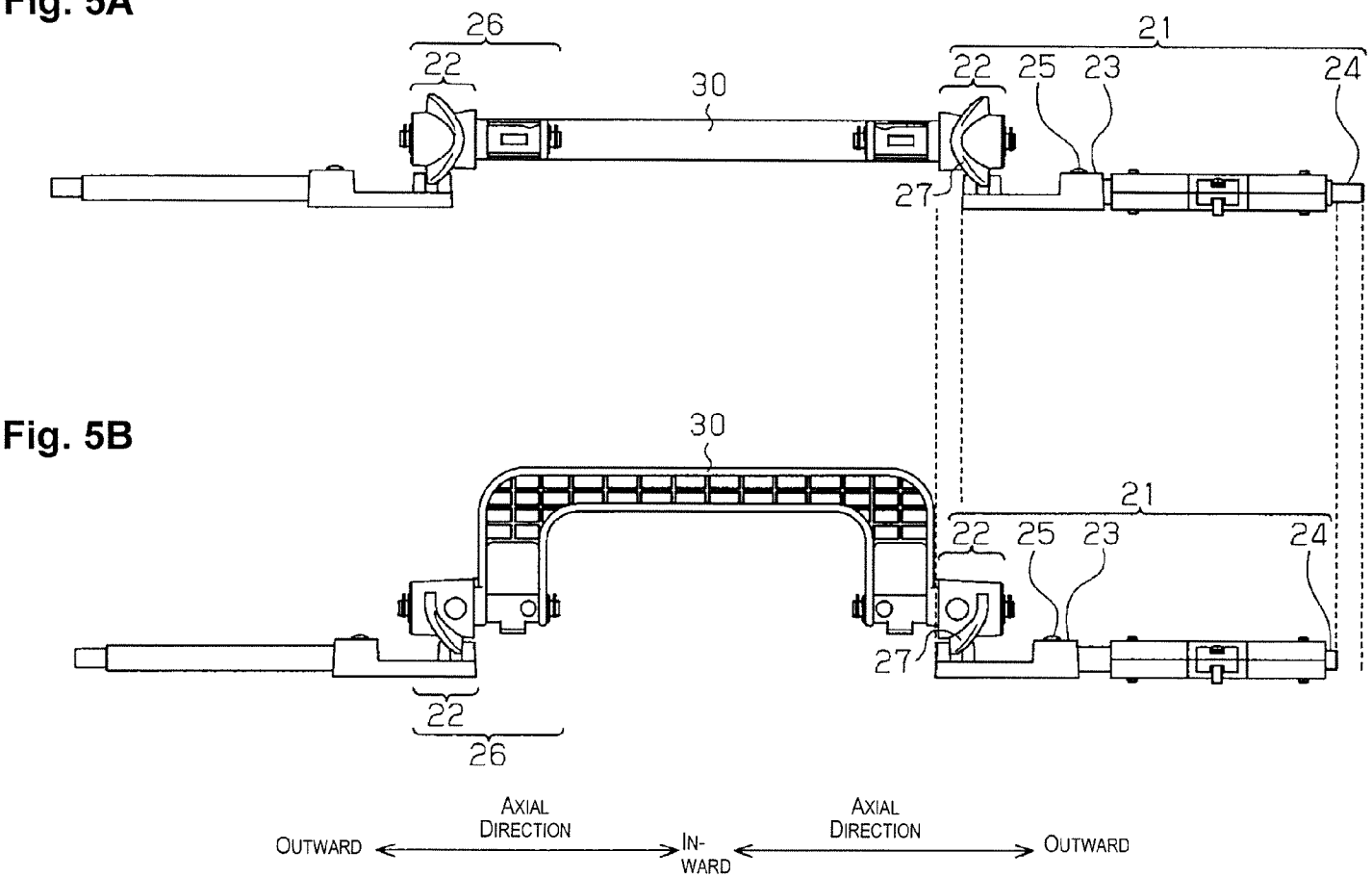

Following is a detailed description, with reference to FIG. 5, of the mechanism for changing the operating position of the locking device to the unlocked state and to the locked state in an interlocked manner with switching of the operating position of the grip portion. As shown in FIGS. 5A and 5B, because the rib 27 of the cylindrical cam 22 is formed so as to encircle the turn shaft 26 in the rotation direction, the position of meshing with the cam receiving portion 23 differs depending on the position status of the grip portion 30. Specifically, as shown in FIG. 5A, with the grip portion 30 retracted in the first operating position, meshing occurs between the cam receiving portion 23 and a portion of the rib 27 attached at an outward position in the axial direction of the turn shaft 26. Here, the axial direction of the turn shaft 26 is the same direction as the lengthwise direction in FIG. 2. On the other hand, as shown in FIG. 5B, with the grip portion 30 extended in the second operating position, meshing occurs between the cam receiving portion 23 and a portion of the rib 27 attached at an inward position in the axial direction of the turn shaft 26. Therefore, when the grip portion 30 is switched from the first operating position to the second operating position, the cam receiving portion 23, which previously meshed with the portion of the rib 27 attached at an outward position, now meshes with the portion of the rib 27 attached at an inward position in the axial direction of the turn shaft 26, whereby the cam receiving portion 23 moves from the outside towards the inside in the axial direction. In association therewith, the locking pin 24 which is fastened to the cam receiving portion 23 also moves inward in the axial direction. As a result, the locking pin 24, which was previously inserted into the lock hole in the printer chassis, now withdraws and the locking device 21 assumes the unlocked state. On the other hand, when the grip portion 30 is switched from the second operating position to the first operating position, the cam receiving portion 23, which previously meshed with the portion of the rib 27 attached at an inward position, now meshes with the portion of the rib 27 attached at an outward position in the axial direction, whereby the cam receiving portion 23 moves from the inside towards the outside in the axial direction. In association therewith, the locking pin 24 which is fastened to the cam receiving portion 23 also moves outward in the axial direction. As a result, the locking pin 24, which was previously withdrawn from the printer chassis, now inserts into the lock hole and the locking device 21 assumes the locked state.

The embodiment described hereinabove affords effects such as the following.

(1) In the preceding embodiment, locking of the printer chassis and the heater unit chassis, and unlocking of the printer chassis and the heater unit chassis, takes place in interlocked manner with operation of the grip portion 30 by the user, and therefore operations to replace the heater unit 20 may be carried out easily.

(2) In the preceding embodiment, when in the first operating position, i.e., with the locking device 21 held in the locked state, the grip portion 30 is retracted into the heater unit chassis. Consequently, in the locked state the heater unit 20 can have a small profile. On the other hand, when in the second operating position, i.e., with the locking device 21 held in the unlocked state, the grip portion 30 extends from the heater unit chassis. Consequently, the grip portion 30 may be grasped to attach or detach the heater unit.

(3) In the preceding embodiment, a feature whereby the printer chassis and the heater unit chassis lock in association with a change from the first operating position to the second operating position may be realized through application of a generic technique, namely, a cam mechanism.

(4) In the preceding embodiment, the plugs 42 provided as electrical contacts are positioned so as to be situated in the vicinity of the lock holes of the printer chassis in the locked state, thereby electrically connecting the printer chassis and the heater unit 20 in the vicinity of the locations at which the contacts are positioned through locking. Consequently, faulty electrical contact between the printer chassis and the heater unit 20 due to the effect of tolerance may be inhibited.

The preceding embodiment may be modified in the following manner.

Whereas the preceding embodiment employs a cylindrical rib cam as the cylindrical cam 22, comparable effect may be achieved using a cylindrical groove cam instead.

In the preceding embodiment, the grip portion 30 retracts into the heater unit chassis in the first operating position, and the grip portion 30 extends from the heater unit chassis in the second operating position, but other configurations are possible as well. For example, in another possible configuration a handle designed to be grasped together with the grip portion during gripping is provided, and a condition in which this handle is released is designated as the first operating position while a condition in which this handle is grasped together with the grip portion 30 is designated as the second operating position. By additionally furnishing the heater unit with a locking device that assumes a released state when the handle is grasped and a locked state when the handle is released, effects comparable to the preceding embodiment may be obtained.

Whereas the preceding embodiment describes embodying the liquid ejection device as an inkjet printer, liquid ejection devices that jet or eject other liquids besides ink may be employed as well. Adaptation for use in liquid ejection devices of various kinds furnished with a liquid ejection head for generating minutely small droplets is also possible. Herein, drop refers to the condition in which a liquid is ejected from the liquid ejection device, and includes granular shape, teardrop shape, or filiform shape having a tail. Herein, liquids may be any material able to be ejected from a liquid ejection device. For example, any materials in which the substance is in the liquid phase are acceptable, such as liquids of high or low viscosity, sols, gel water, and materials in other flowable states such as inorganic solvents, organic solvents, solutions, liquid resins, liquid metals (molten metals); nor are liquids limited to those containing a single state of matter, and may include those in which particles of functional materials composed of solids, such as pigments, metal powders, or the like, dissolved, dispersed, or mixed into a medium as well. Ink, such as described in the preceding embodiment, or liquid crystals, may also be cited as typical examples of liquids. Here, the term ink is used to include ordinary water based inks and oil based inks, as well as various types of liquid compositions such as gel inks, hot-melt inks, and the like. Specific examples of liquid ejection devices are liquid ejection devices for ejecting liquids that contain materials such as electrode materials or coloring matter in dispersed or dissolved form, used for manufacturing, for example, liquid crystal displays, EL (electroluminescence) displays, surface emitting displays, color filters, and the like; liquid ejection devices for ejecting bioorganic compounds for use in biochip manufacture; liquid ejection devices for ejecting liquids as specimens used as a precision pipettes; textile printing devices; microdispensers, or the like. Liquid ejection devices for pinpoint ejecting of lubricants into precision instruments such as clocks or cameras; liquid ejection devices configured to eject a solution of an ultraviolet-curing resin or other transparent resin onto substrates for the purpose of forming micro semispherical lenses (optical lenses) for use in an optical communication components etc.; or liquid ejection devices configured to eject acid or alkali etchant solutions for etching circuit boards, etc., may also be employed. The present invention may be implemented in any one of these types of liquid ejection device.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A heater unit comprising:

a locking device selectable between a locked state in which a heater unit chassis is locked in a printer chassis, and an unlocked state in which the printer chassis and the heater unit chassis are unlocked; and a grip portion configured to be gripped by an operator during a replacement operation, the grip portion and the locking device being arranged such that when the grip portion is in a first operating position, the locking device is held in the locked state, when the grip portion is in a second operating position, the locking device is held in the unlocked state, an operating state of the locking device changes from the locked state to the unlocked state in an interlocked manner with switching of a operating position of the grip portion from the first operating position to the second operating position, and the operating state of the locking device changes from the unlocked state to the locked state in an interlocked manner with switching of the operating position of the grip portion from the second operating position to the first operating position.

2. The heater unit according to claim 1, wherein the grip portion retracts into the heater unit chassis in the first operating position, and extends from the heater unit chassis in the second operating position.

3. The heater unit according to claim 1, wherein the grip portion switches the operating position by turning about a turn shaft disposed in the heater unit chassis, the locking device includes a cam disposed on a perimeter of the turn shaft and configured to turn in tandem with the turn shaft, a cam receiving portion configured to travel in an axial direction of the turn shaft in association with change of contact location with the cam, and a locking pin configured to travel in an axial direction of the turn shaft in tandem with the cam receiving portion, and when the operating position of the grip portion changes from the first operating position to the second operating position in association with turning of the grip portion, a contact location of the cam and the cam receiving portion changes due to turning of the cam in tandem with turning of the turn shaft, and due to the change in the contact location, the cam receiving portion and the locking pin travel in an axial direction of the turn shaft, the locking pin is inserted into a lock hole of the printer chassis, and the printer chassis and the heater unit chassis are locked through insertion of the locking pin into the lock hole.

4. The heater unit according to claim 3, further comprising electrical contacts for electrical connection to the printer chassis, with the electrical contacts being positioned in the vicinity of the lock holes of the printer chassis in the locked state.

5. A liquid ejection device comprising:

a liquid ejection head configured to eject a liquid onto a recording medium;

a feed unit configured to feed the recording medium along a feed path for feeding the recording medium onto which the liquid has been ejected by the liquid ejection head; and the heater unit according to claim 1 disposed on the feed path to dry the liquid on the recording medium.

6. A liquid ejection device comprising:

a liquid ejection head configured to eject a liquid onto a recording medium;

a feed unit configured to feed the recording medium along a feed path for feeding the recording medium onto which the liquid has been ejected by the liquid ejection head; and the heater unit according to claim 2 disposed on the feed path to dry the liquid on the recording medium.

7. A liquid ejection device comprising:

a liquid ejection head configured to eject a liquid onto a recording medium;

a feed unit configured to feed the recording medium along a feed path for feeding the recording medium onto which the liquid has been ejected by the liquid ejection head; and the heater unit according to claim 3 disposed on the feed path to dry the liquid on the recording medium.

8. A liquid ejection device comprising:

a liquid ejection head configured to eject a liquid onto a recording medium;

a feed unit configured to feed the recording medium along a feed path for feeding the recording medium onto which the liquid has been ejected by the liquid ejection head; and the heater unit according to claim 4 disposed on the feed path to dry the liquid on the recording medium.

* * * * *